US005817998A

United States Patent [19]

Siebels et al.

[11] Patent Number: 5,817,998

[45] Date of Patent: Oct. 6, 1998

[54] CIRCUIT BREAKER WITH HANDLE LOCKING DEVICE

[75] Inventors: Randall Luther Siebels, Cedar Rapids; Douglas Paul Van Waart, Anamosa; Donald Charles Francis, Jr., Cedar Rapids, all of Iowa

[73] Assignee: Square D Company, Palatine, Ill.

[21] Appl. No.: 835,761

[22] Filed: Apr. 8, 1997

Related U.S. Application Data

[63] Continuation of Ser. No. 644,991, May 14, 1996, abandoned.

[51] Int. Cl.[6] ..... H01H 9/28

[52] U.S. Cl. ..... 200/43.14; 200/43.16

[58] Field of Search ..... 200/43.14, 43.16, 200/43.19, 43.11, 43.01

[56] References Cited

U.S. PATENT DOCUMENTS

| | | | |
|---|---|---|---|
| 3,076,876 | 2/1963 | Stanback et al. | 200/44 |
| 3,376,400 | 4/1968 | Batt et al. | 200/42 |
| 3,426,164 | 2/1969 | Dessert | 200/42 |
| 3,595,040 | 7/1971 | Curl | 70/203 |
| 4,677,261 | 6/1987 | Nourry | 200/43.01 |
| 5,412,167 | 5/1995 | Mueller et al. | 200/43.14 |

*Primary Examiner*—David J. Walczak
*Attorney, Agent, or Firm*—Kareem M. Irfan; Larry I. Golden

[57] ABSTRACT

The present invention provides an electrical switch locking assembly for inhibiting movement of a switch handle. The switch handle is enclosed in a casing or housing and moves operatively along a path between first and second positions to open or close electrical contacts for opening or closing a circuit. First and second recesses are molded into the casing to receive a locking device across the path of the switch handle. The locking device has first and second legs pivotally connected like scissors. The first leg has an integral first foot projecting away from the second leg, and the second leg has an integral second foot projecting away from the first leg, like scissor-blade tips having opposing projections. The first and second legs each have an opening opposite the first and second foot, respectively, somewhat like scissor handles. The first foot is inserted into the first recess and the second foot is inserted into the second recess. A locking shaft, such as a padlock or screw, is secured in the opening to hold the feet in engagement with the recesses. The locking device is thus engaged across the path of movement of the switch handle so that the switch handle can be locked in a desired position. In this manner a circuit can be maintained in either a de-energized or energized state until a change is authorized.

32 Claims, 5 Drawing Sheets

CIRCUIT BREAKER WITH HANDLE LOCKING DEVICE

This is a continuation, of application Ser. No. 08/644,991, filed May 14, 1996, now abandoned.

BACKGROUND OF THE INVENTION

1. Field of the Invention

This invention relates generally to electric circuit breakers and switches. More particularly, this invention relates to a circuit breaker or switch having a locking device for its switch handle.

2. Description of the Related Art

Electrical switches and/or circuit breakers are used in electrical circuits to open or close the electrical circuit. Placing a switch in an "off" position typically opens a circuit, and in this position a circuit is de-energized. On the other hand, placing a switch in an "on" position typically closes a circuit, and in this position a circuit is energized.

For various reasons it is desirable to fix and/or lock a switch in either its "off" or "on" position. Several devices for this purpose have been patented. U.S. Pat. No. 5,412,167, issued to Mueller et al., discloses a locking device that is insertable into a cover opening adjacent to a handle of an electrical switch to occupy the space in the cover opening for resisting movement of the handle. This locking device has two pivotally connected members. One of the members has a handle shroud member, which has an opening for receiving the switch handle. The second member has leg means along its base for engaging an undersurface around the cover opening when the locking device is in an expanded position.

U.S. Pat. No. 3,595,040, issued to Curl, discloses a handle lock attachment securable to a casing of a molded-case electric circuit breaker. The handle lock attachment has a pivotable handle locking member securable either by a screw or a padlock in interfering relationship with operation of the handle of the circuit breaker. The handle lock attachment is mounted to the casing of an electric circuit breaker adjacent to its switch handle. Following this installation, a padlock may be used to prevent unauthorized operation of the circuit breaker switch handle.

U.S. Pat. No. 3,426,164, issued to Dessert, discloses a multipole circuit breaker having a factory-installed handle locking member. The locking member is pivotably and extensibly-retractably trapped between adjacent casings of two single-pole molded-case circuit breakers secured together to form the multipole circuit breaker. The handle locking member may be locked by a padlock in an extended position in which it blocks attempted movement of a handle tie member securing together separate operating handles of two or more single-pole circuit breakers. This handle locking member is limited to multipole circuit breakers.

U.S. Pat. No. 3,376,400, issued to Batt et al., discloses a handle locking attachment for a pivotable operating handle extending outwardly of a boss on a case of a molded case circuit breaker. A rectangular frame of the attachment fits around the boss and is secured to the case. A bail is pivotally mounted on the side portions of the frame and receives a padlock in interfering relationship with movement of the handle.

Although a number of patents have issued on handle locking devices, a need remains for a simple device that is easily installed and inexpensive to manufacture. Handle locking devices are used frequently to ensure that a circuit remains de-energized while a person is in contact with the circuit performing a task. To encourage its use, the handle locking device should be simple and easy to install so that installation can be completed quickly. Low manufacturing costs allow the handle locking device to be sold inexpensively, leading to widespread availability. The present invention provides a switch or circuit breaker having a casing design and a handle locking device to satisfy these needs.

SUMMARY OF THE INVENTION

The present invention provides a circuit breaker for interrupting power in a circuit path between a source and a load. The circuit breaker has an electro-mechanical assembly including first and second contacts cooperatively arranged in the circuit path for providing current from the source to the load. At least one of the contacts is movable for interrupting the power provided to the load, and a terminal is connected to the first contact. A switch handle is operatively engaged with the electro-mechanical assembly for interrupting the power provided to the load. A casing encloses the electro-mechanical assembly so that the switch handle is accessible for operation. The casing has first and second recesses adjacent the switch handle. A locking device is removably engaged in the first and second recesses for interfering with the operation of the switch handle.

In a preferred embodiment the locking device comprises a first leg and a second leg pivotally connected to the first leg. Preferably, the locking device has a first foot integral with the first leg and a second foot integral with the second leg, and the first foot and the second foot engage the first and second recesses, respectively. Preferably, the first and second legs each have an opening for receiving a locking shaft, such as a screw or padlock. In a preferred embodiment the first and second legs are interchangeable.

In another aspect the invention provides a method for interfering with movement of an electrical switch handle. The method includes (a) molding a casing having a first and second recesses adjacent the switch handle, (b) obtaining a locking device for interfering with movement of the electrical switch handle, (c) inserting the locking device into the first and second recesses and (d) inserting a locking shaft through the locking device. The locking device comprises (a) a first leg having opposing first and second ends, (b) a first foot integral with the first end of the first leg, (c) a second leg pivotally connected at a pivot point to the first leg, the second leg having opposing first and second ends, and (d) a second foot integral with the first end of the second leg, wherein the first and second legs have first and second openings, respectively, for receiving the locking shaft. The first foot is inserted into the first recess and the second foot is inserted into the second recess.

Examples of the more important features of the invention have been summarized rather broadly in order that the detailed description thereof that follows may be better understood, and in order that the contributions to the art may be appreciated. There are, of course, additional features of the invention that will be described hereinafter and which will form the subject of the claims appended hereto.

BRIEF DESCRIPTION OF THE DRAWINGS

For detailed understanding of the present invention, references should be made to the following detailed description of the preferred embodiment, taken in conjunction with the accompanying drawings, in which like elements have been given like numerals, similar elements have been given letter suffixes, and wherein.

DETAILED DESCRIPTION OF THE PREFERRED EMBODIMENT

Figure 1:
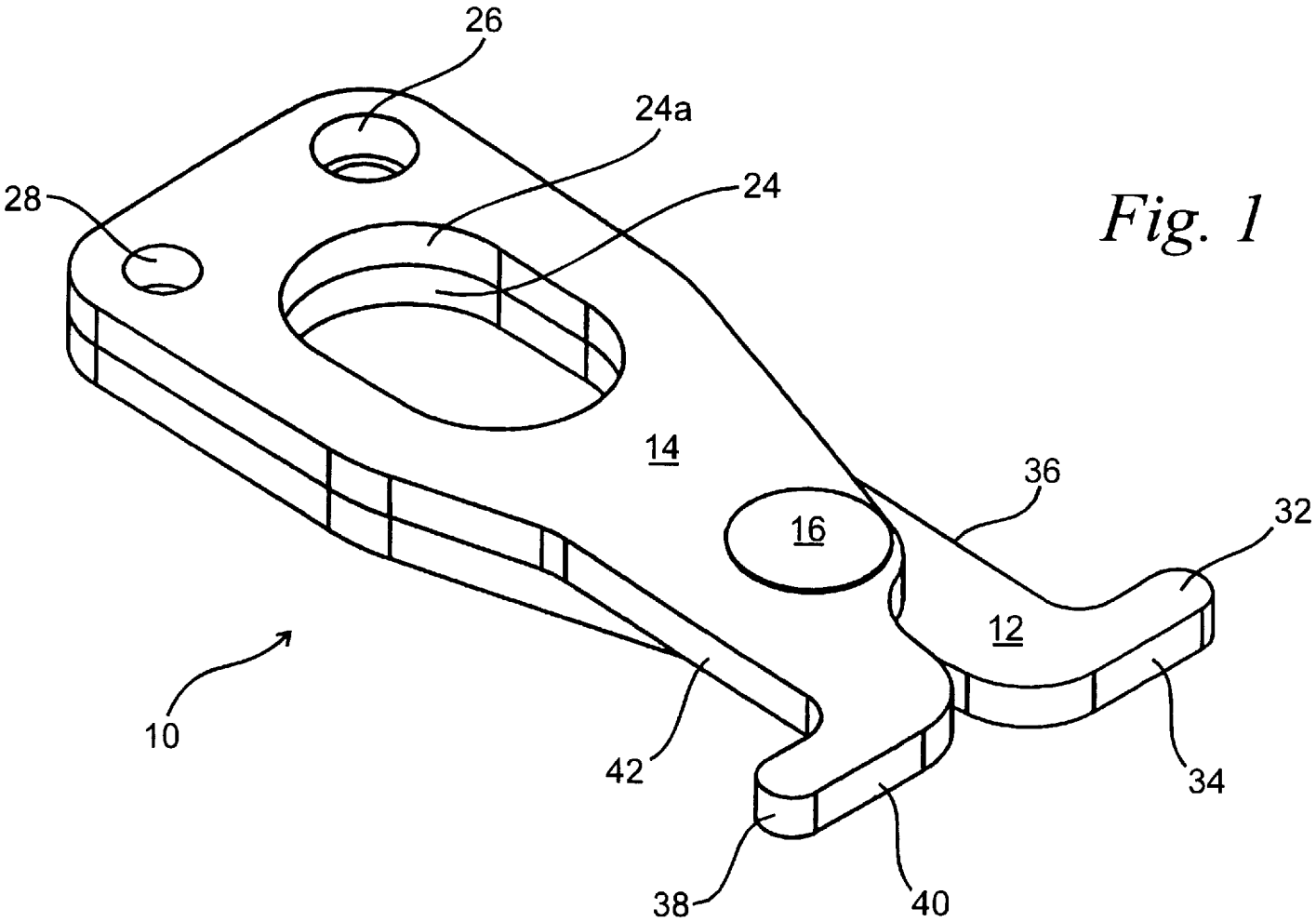
FIG. 1 is a perspective view of a locking device for a switch handle according to the present invention.

With reference to the drawings where like elements are labeled with like numbers, FIG. 1 shows a perspective view of a locking device 10 for a switch handle. The locking device 10 is preferably made of case hardened and plated steel parts. The locking device 10 has a first leg 12 connected to a second leg 14 by a pivotable rivet 16.

Figure 2:
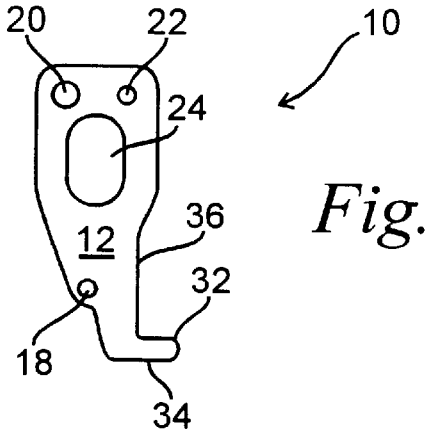
FIG. 2 shows a plan view of one leg of a locking device for a switch handle.
Figure 3:
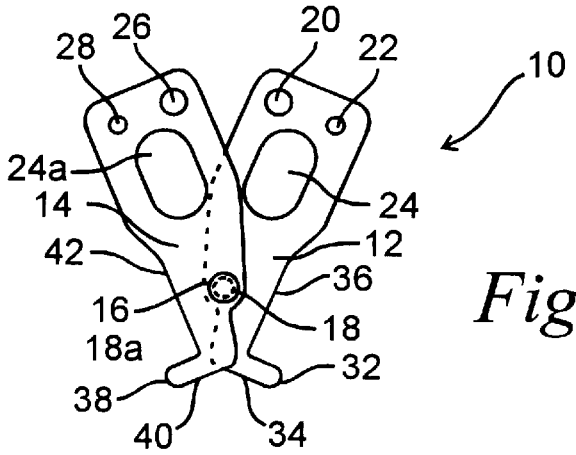
FIG. 3 shows a plan view of a locking device for a switch handle in its contracted position.
Figure 4:
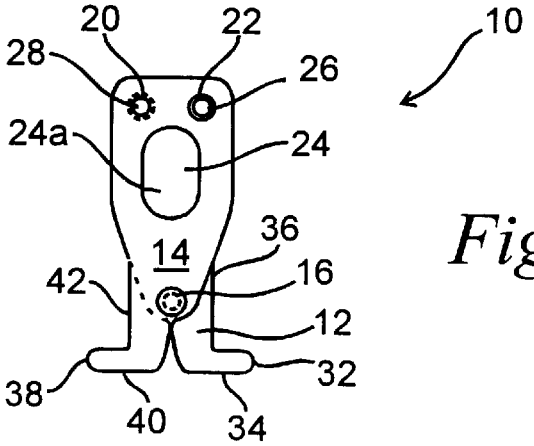
FIG. 4 shows a plan view of a locking device for a switch handle in its expanded position.

FIG. 2 shows a plan view of the first leg 12 of the locking device 10. The first leg 12 has a pivot hole 18, a clearance hole 20, a tapped hole 22, and a slot 24. FIGS. 3 and 4 show a plan view of the locking device for a switch handle 10 in its contracted and expanded positions, respectively. As best seen in FIG. 3, the second leg 14 has a slot 24*a*, a clearance hole 26 and a tapped hole 28. As shown in FIG. 4, the clearance hole 20 of the first leg 12 aligns with the tapped hole 28 of the second leg. Similarly, the clearance hole 26 of the second leg 14 aligns with the tapped hole 22 of the first leg. The manner in which each clearance hole has been paired and aligned with each tapped hole allows a screw to pass through the clearance hole 20, 26 and thread into the tapped hole 22, 28. The clearance and tapped holes are arranged so that the screw can first pass through the clearance hole 20, 26 and then thread into the tapped hole 22, 28, regardless of whether the first leg 12 or the second leg 14 is facing the screw.

The first leg 12 and the second leg 14 are substantially identical parts. The first leg 12 and the second leg 14 are interchangeable so that a single leg is manufactured. Although not shown, it is apparent from FIGS. 3 and 4 that the second leg 14 has a pivot hole 18*a*. The rivet 16 pivotally connects the first leg 12 to the second leg 14. The rivet 16 passes through the pivot hole 18 in the first leg 12 and through the pivot hole 18*a* in the second leg 14.

With reference to FIGS. 1–4, the first leg 12 has a first foot 32, which has a base 34. The first leg 12 has an edge 36 which is substantially parallel to the longitudinal axis of the first leg 12. The second leg 14 is substantially identical to the first leg 12 and has corresponding aspects and features. Thus, the second leg 14 has a second foot 38, a base 40, and an edge 42, which is substantially parallel to the longitudinal axis of the second leg 14. Although the first leg 12 and the second leg 14 are substantially identical parts, one is turned over or flipped over before connection to the other. Thus, the feet 32, 38 point in opposite directions.

Figure 5:
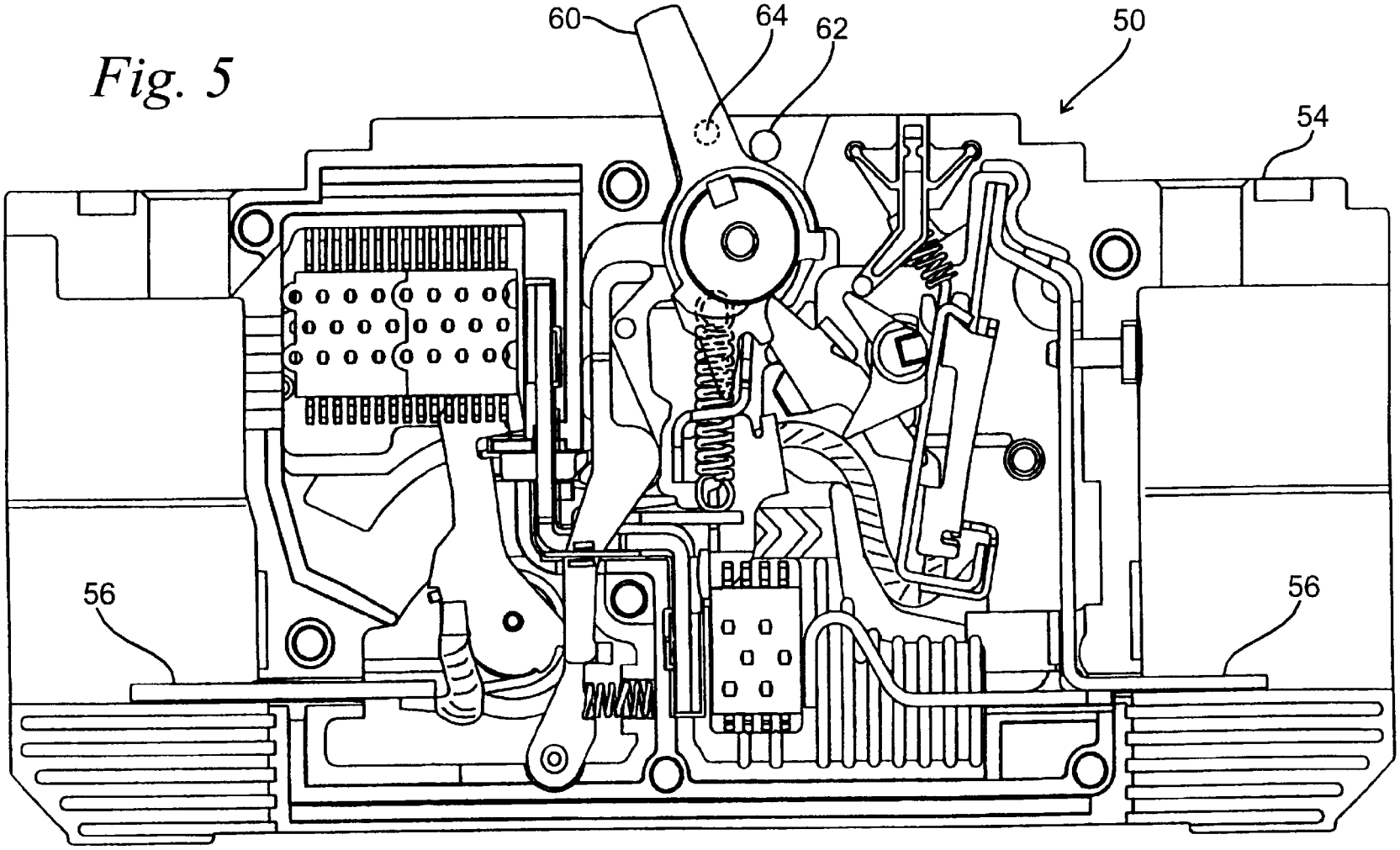
FIG. 5 shows a plan view of a circuit breaker with its cover removed.

Turning now to FIG. 5, a circuit breaker 50 is shown without its cover. An electro-mechanical assembly 52 is held by a base 54 and a cover (not shown), which matingly engages the base 54 to secure and enclose the electro-mechanical assembly 52. The electro-mechanical assembly 52 has terminals 56 and 58 for connection into an electrical circuit. The electro-mechanical assembly 52 has a switch handle 60 operatively connected to it so that a person can move the switch handle 60 from a first position to a second position to open or close the electrical circuit by breaking or making contact between first and second contacts.

The base 54 has a first base recess 62 and a second base recess 64. The second recess 64 is behind the switch handle 60, so it is shown as a hidden circle. Although not shown, the cover has first and second cover recesses 63, 65 which mate with and are directly across from the first and second base recesses 62, 64, respectively. The first recesses 62, 63 receive the feet 32, 38 of the locking device 10 to lock the switch handle 60 in a first position. The second recesses 64, 65 receive the feet 32, 38 of the locking device 10 to lock the switch handle 60 in a second position. The first and second positions of the switch handle 60 may correspond to "on" and "off" positions, which may correspond to closed-circuit and open-circuit positions for contacts within the electro-mechanical assembly 52.

Figure 6:
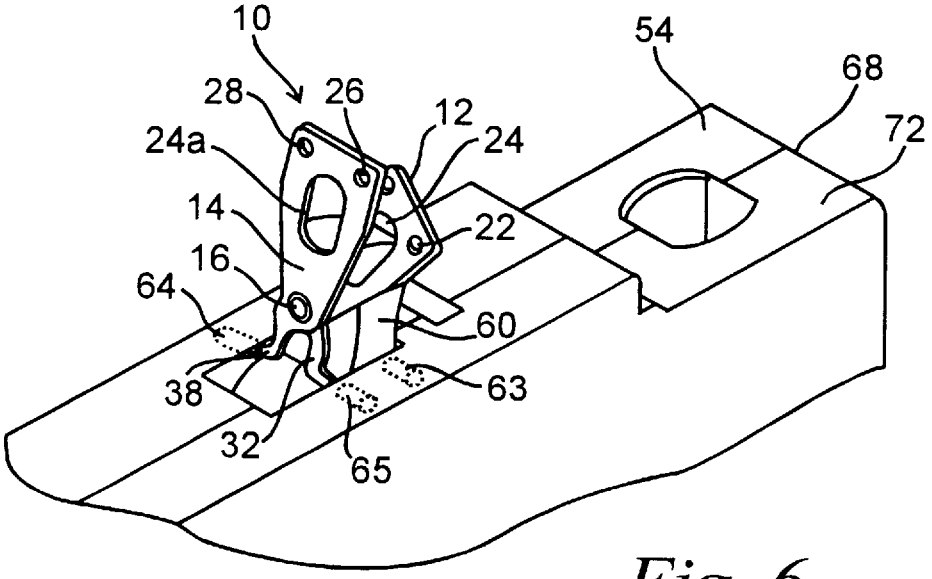
FIG. 6 shows a partial view of a circuit breaker and a locking device for a switch handle in its contracted position.
Figure 7:
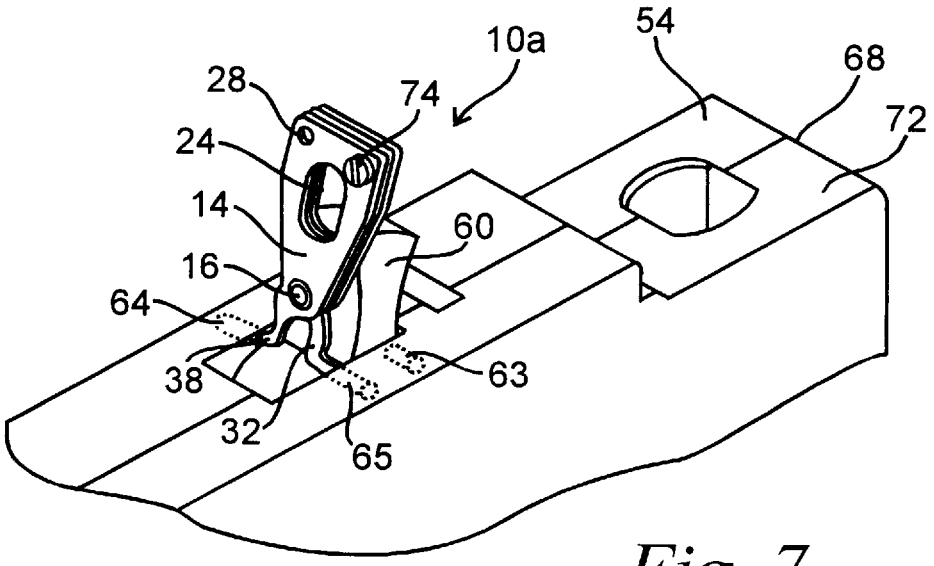
FIG. 7 shows a partial view of a circuit breaker and a locking device for a switch handle in its expanded position.
Figure 8:
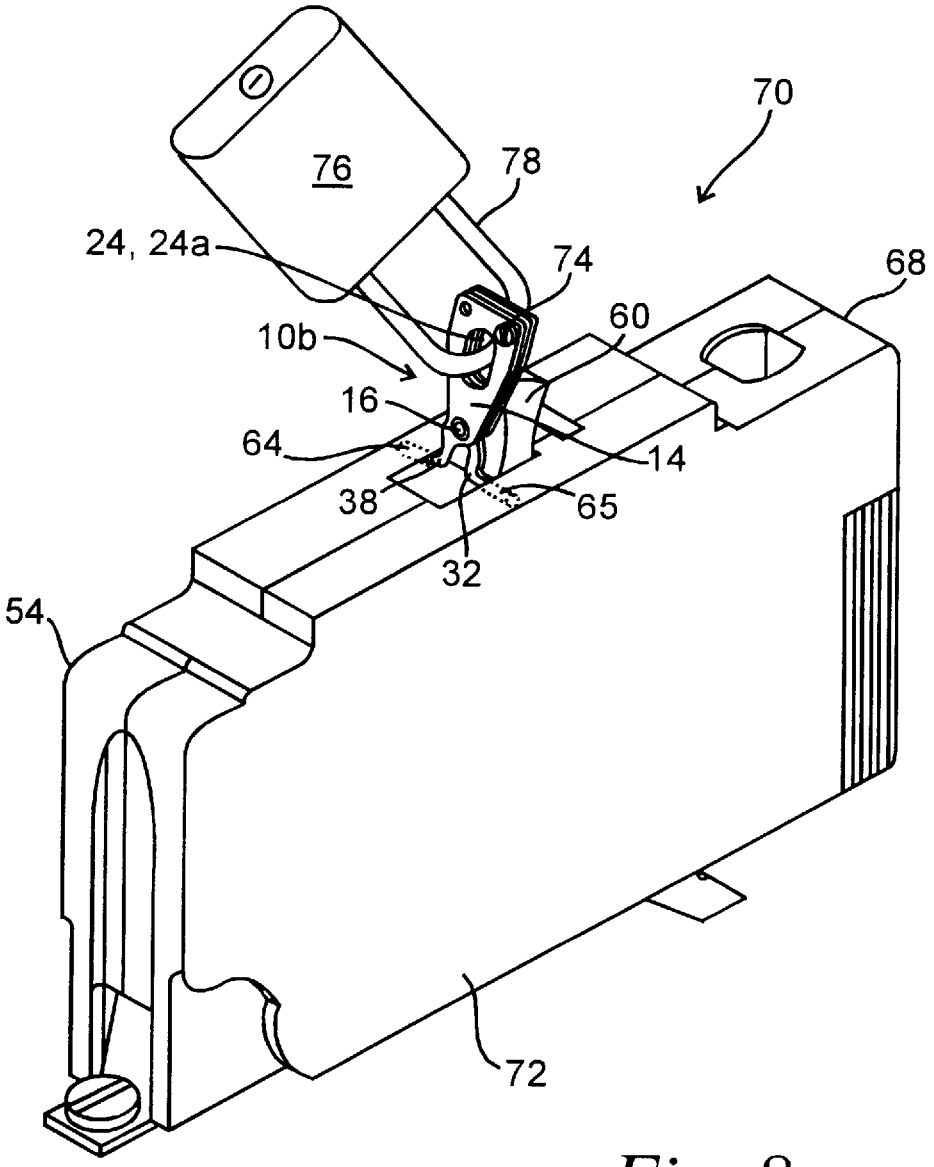
FIG. 8 shows a circuit breaker and a locking device for a switch handle having a padlock according to the present invention.

FIGS. 6, 7, and 8 illustrate the use of the locking device 10. FIGS. 6 and 7 show a perspective of a portion of a circuit breaker 68, and FIG. 8 shows a perspective of a complete circuit breaker 68. The base 54 and the electro-mechanical assembly 52 of the circuit breaker 68 were shown in FIG. 5. FIG. 8 shows the circuit breaker 68 with its cover 72 and base 54. The locking device 10 combined with the circuit breaker 68 comprise a switch locking assembly 70.

As shown in FIG. 6, the locking device 10 is placed in a contracted position, where the feet 32, 38 are closer together, before insertion into the recesses 64, 65. As shown in FIG. 7, the foot 38 is inserted into the recess 64, and the foot 32 is inserted into the recess 65. FIGS. 7 and 8 show the locking device in its expanded position, where the feet 32, 38 are farther apart. The legs 12 and 14 pivot on the rivet 16 between the contracted and expanded positions. In the expanded position illustrated in FIG. 7, pivoting of the locking device 10*a* may be prevented by threading a screw 74 through the clearance hole 26 and into the tapped hole 22. Threads on the screw 74 engage threads in the tapped hole 22 so that the screw 74 can be tightened.

In the position illustrated in FIG. 7, the switch handle 60 cannot move to a different position. The switch handle 60 is locked in position by the locking device 10*a*. The screw 74 prevents the locking device 10*a* from pivoting from its expanded position to a contracted position. The feet 32, 38 are firmly engaged in the recesses 64, 65, respectively. If an attempt were made to move the switch handle 60 from its illustrated second position to its first position, the switch handle 60 would contact the bases 34 and 40 of the feet 32 and 38, respectively, and be prevented from changing positions.

FIG. 8 illustrates a locking device 10*b* locked in the recesses 64, 65. A padlock 76, having a U-shaped bar 78 inserted through the slots 24, 24*a*, may be used to fix the locking device 10*b* in its expanded position. The U-shaped bar 78 prevents the locking device 10*b* from pivoting from its expanded position to its contracted position. The switch handle 60 is locked into a fixed position. Where a padlock 76 is used, the use of the screw 74 is optional because the U-shaped bar 78 serves as a locking shaft to prevent the legs 12 and 14 from pivoting substantially about the rivet 16. Multiple padlocks can be used by inserting a ganging attachment (not shown) through the slots 24, 24*a*. Multiple padlocks can then be inserted through the ganging attachment. All padlocks would have to be removed from the ganging attachment before it could be removed from the slots 24, 24*a*. In this case the ganging attachment serves as the locking shaft and would have to be removed before the locking device 10*b* could be removed. Alternatively, the legs 12, 14 and the slots 24, 24*a* can be modified to accommodate multiple padlocks.

An electrician can de-energize a circuit having the circuit breaker 68 by placing the switch handle 60 in its "off" position. The electrician can install the locking device 10 into the appropriate pair of recesses 62, 63 or 64, 65. The electrician can ensure that the switch handle 60 remains in its "off" position by placing the U-shaped bar 78 of the padlock 76 through the slots 24, 24*a* and locking the padlock 76. With the circuit de-energized and the circuit breaker 68 locked into its "off" position, the electrician can safely work on the de-energized circuit. When the electrician is finished working on the circuit, he or she can unlock the padlock 76, remove the locking device 10, and move the switch handle 60 into its "on" position.

Thus, the switch locking assembly 70 provides a system for locking a switch handle into a fixed position. The switch handle 60 of a circuit breaker 68 has been used to illustrate the system, but the system can be applied to additional types of switches. The switch locking assembly 70 can be used for most switches for interrupting power in a circuit path between a current source and a load. The components of the system comprise a switch handle enclosed in a casing having transverse recesses adjacent to the switch handle for receiving the feet 32, 38 of a locking device 10 and a padlock 76 inserted through the slots 24, 24*a* to fix the locking device 10 in its expanded position. In the switch locking assembly 70, the switch handle has at least first and second positions along a longitudinal path of movement. The locking device 10 can be fixed in a position across the longitudinal path of movement of the switch handle to interfere with the movement and block the switch handle from moving past the locking device 10.

To summarize, in one aspect the present invention provides the locking device 10 for a switch handle 60. The locking device 10 has a pair of legs 12 and 14 pivotally connected by a rivet 16. The legs 12 and 14 can be pivoted between a contracted position, as illustrated in FIG. 3, and an expanded position, as illustrated in FIG. 4. In another aspect the present invention provides the switch locking assembly 70, which includes a switch casing and /or enclosure having recesses like 62, 63, 64, and 65 operatively located to receive the feet 32 and 38 of the locking device 10 and fix a switch handle like 60 in a particular position. A padlock 76 and/or a screw 74 can hold the locking device 10 in its expanded position where the feet 32 and 38 are engaged in a pair of recesses such as 64 and 65. Thus, the switch locking assembly 70 holds the switch handle 60 in a fixed position until the padlock 76 and the locking device 10 are removed.

The present invention provides several benefits and advantages over the existing art. The present invention uses relatively thick, hardened steel to provide a very strong locking device 10. The locking device 10 engages recesses in a strong molded casing so that the locking assembly 70 provides a strong system for ensuring a safe and reliable lockoff and/or lockout system. The locking device uses only two different parts, the leg 12 or 14 and the rivet 16. The leg 12 is merely flipped or turned over to provide the leg 14. The leg 12 or 14 can be stamped, formed and threaded in one machine requiring only case hardening and plating before being riveted. Neither complicated forming operations nor tight tolerances are required. By taking advantage of the scissor-like pivotal movement of the legs 12, 14 and optimizing the relative distances between the legs 12, 14, pivot holes 18, 18*a* and slots 24, 24*a*, a single locking device 10 can accommodate a variety of padlocks having different sizes of U-shaped bars 78. Further, the locking device 10 can accommodate multiple padlocks by using a ganging attachment in the slots 24, 24*a*, or the locking device 10 can be modified to directly accommodate multiple padlocks.

The foregoing description is directed to a particular embodiment of the present invention for the purpose of illustration and explanation. It will be apparent, however, to one skilled in the art that many modifications and changes to the embodiment set forth above are possible without departing from the scope and the spirit of the invention. It is intended that the following claims be interpreted to embrace all such modifications and changes.

What is claimed is:

1. A switch locking assembly for a switch for interrupting power in a circuit path between a source and a load, comprising;

(a) an electro-mechanical assembly including first and second contacts cooperatively arranged in the circuit path for providing current from the source to the load, wherein at least one of the contacts is movable for interrupting the power provided to the load;

(b) a switch handle operatively engaged with the electro-mechanical assembly for interrupting the power provided to the load;

(c) a casing for enclosing the electro-mechanical assembly, wherein the switch handle is accessible for operation, and a pair of recesses are provided in the casing adjacent the switch handle; and (d) a locking device, comprising a first member and a second member pivotally connected to the first member at a pivot point, said first member and second member being in slidable contact with each other and removably engaged in the pair of recesses for interfering with the operation of the switch handle.

2. The switch locking assembly of claim 1, wherein the first member and the second member are legs.

3. The switch locking assembly of claim 2, wherein the locking device comprises a first foot attached to the first leg and a second foot attached to the second leg, and the first foot and the second foot engage the pair of recesses.

4. The switch locking assembly of claim 3, wherein the first and second legs each have an opening for receiving a locking shaft.

5. The switch locking assembly of claim 4, wherein the first and second legs are interchangeable.

6. A locking device for interfering with movement of an electrical switch handle, comprising:

(a) a first leg having opposing first and second ends; and (b) a second leg pivotally connected at a pivot point to the first leg, the second leg having first and second ends, said first leg and second leg being in slidable contact with each other and having first and second respective openings which are arranged to overlap each other upon pivotal movement of said first leg with respect to said second leg such that; a locking shaft can be received in said openings.

7. The locking device of claim 6, wherein a first foot is integral with the first end of the first leg.

8. The locking device of claim 7, wherein the pivot point is between the first and second ends of the first leg and the first and second ends of the second leg.

9. The locking device of claim 8, wherein the first opening is between the pivot point and the second end of the first leg.

10. The locking device of claim 9, wherein the second leg is interchangeable with the first leg.

11. A method of interfering with the movement of an electrical switch handle, comprising:

(a) molding a casing having a first and second recesses adjacent the switch handle;

(b) obtaining a locking device for interfering with the movement of the electrical switch handle, the locking device comprising:

(i) a first leg having opposing first and second ends, (ii) a first foot integral with the first end of the first leg, (iii) a second leg pivotally connected at a pivot joint to the first leg and in slidable contact with the first leg, the second leg having opposing first and second ends; and (iv) a second foot integral with the first end of the second leg, wherein the first and second legs have first and second openings, respectively, for receiving a locking shaft;

(c) inserting the first foot and the second foot of the locking device into the first recess and second recess of the casing, respectively; and (d) inserting the locking shaft through the first and second opening for inhibiting the pivoting of the second leg on the first leg.

12. A circuit breaker for interrupting power in a circuit path between a source and a load, comprising:

(a) an electro-mechanical assembly including first and second contacts cooperatively arranged in the circuit path for providing current from the source to the load, wherein at least one of the contacts is movable for interrupting the power provided to the load;

(b) a switch handle operatively engaged with the electro-mechanical assembly for interrupting the power provided to the load;

(c) a casing for enclosing the electro-mechanical assembly, wherein the switch handle is accessible for operation, and the casing has first and second recesses adjacent the switch handle; and (d) a locking device, comprising a first member and a second member pivotally connected to the first member at a pivot point, said first member and second member being in slidable contact with each other and removably engaged in the first and second recesses for interfering with the operation of the switch handle.

13. The circuit breaker of claim 12, wherein the locking device comprises a first leg and a second leg pivotally connected to the first leg.

14. The circuit breaker of claim 13, wherein the locking device has a first foot integral with the first leg and a second foot integral with the second leg, and the first foot and the second foot engage the first and second recesses, respectively.

15. The circuit breaker of claim 14, wherein the first and second legs each have an opening for receiving a locking shaft.

16. The circuit breaker of claim 15, wherein the first and second legs are interchangeable.

17. The circuit breaker of claim 16, wherein the first leg is a flat plate.

18. The circuit breaker of claim 12, wherein the switch handle moves in a path, and the locking device is transverse to the path.

19. The circuit breaker of claim 18, wherein the locking device comprises first and second legs pivotally connected.

20. The circuit breaker of claim 19, wherein the first leg has an integral first foot and the second leg has an integral second foot, and the first foot and second foot engage the first and second recesses, respectively.

21. A switch locking assembly for a circuit breaker for interrupting power in a circuit path between a source and a load, comprising;

(a) an electro-mechanical assembly including first and second contacts cooperatively arranged in the circuit path for providing current from the source to the load, wherein at least one of the contacts is movable for interrupting the power provided to the load;

(b) a switch handle operatively engaged with the electro-mechanical assembly for interrupting the power provided to the load;

(c) a casing for enclosing the electro-mechanical assembly, wherein the switch handle is accessible for operation, and a first and second recesses are provided in the casing adjacent the switch handle; and (d) a locking device comprising:

(i) a first member having first and second ends, a first opening and a first substantially flat surface, the first end being adapted to removably engage with the first recess;

(ii) a second member having third and fourth ends, a second opening and a second substantially flat surface, the second member pivotally connected to the first member at a pivot point, the first and second substantially flat surfaces in slidable contact, the third end being adapted to removably en gage with the second recess; and (iii) a device capable of being inserted through the first and second openings.

22. The switch locking assembly of claim 21, wherein the first member and the second member are legs.

23. The switch assembly of claim 22, wherein the first end comprises a foot integral with the first leg and the third end comprises a foot integral with the second leg.

24. A locking device for use in locking a circuit breaker having a switch handle and first and second recesses adjacent to the switch handle, comprising:

(a) a first member having a first substantially flat surface and a first end that is adapted to be removably engaged with the first recess, and (b) a second member having a second substantially flat surface and a second end that is adapted to be removably engaged with the second recess, the second member being pivotally connected at a pivot point to the first member; the first and second substantially flat surfaces being in slidable contact with each other.

25. The locking device of claim 24 wherein the first and second members have first and second openings, respectively, for receiving a locking member.

26. A method for interfering with the movement of an electrical switch handle, comprising:

(a) molding a casing having a first and second recesses adjacent the switch handle;

(b) obtaining a locking device for interfering with the movement of the electrical switch handle, the locking device comprising:

(i) a first member having opposing first and second ends and a first substantially flat surface;

(ii) a first foot integral with the first end;

(iii) a second member pivotally connected at a pivot point to the first member, the second member having opposing third and fourth ends and a second substantially flat surface, the second substantially flat surface being in slidable contact with the first substantially flat surface; and (iv) a second foot integral with the third end, wherein the first and second members have first and second openings, respectively, for receiving a locking member;

(c) inserting the first and second foot of the locking device into the first recesses and the second recess of the casing, respectively; and (d) inserting the locking member through the first and second openings for inhibiting the pivoting of the second leg on the first leg.

27. A circuit breaker for interrupting power in a circuit path between a source and a load, comprising:

(a) an electro-mechanical assembly including first and second contacts cooperatively arranged in the circuit path for providing current from the source to the load, wherein at least one of the contacts is movable for interrupting the power provided to the load;

(b) a switch handle operatively engaged with the electro-mechanical assembly for interrupting the power provided to the load;

(c) a casing for enclosing the electro-mechanical assembly, wherein the switch handle is accessible for operation, and the casing has first and second recesses adjacent the switch handle; and (d) a locking device, comprising:

(i) a first member having a first substantially flat surface, and (ii) a second member having a second substantially flat surface, the second member being pivotally connected to the first member by a pivot at a pivot point, the second substantially flat surface being in slidable contact with the first substantially flat surface, the locking device removably engaged in the first and second recesses for interfering with the operation of the switch handle.

28. The circuit breaker of claim 12 wherein the first member and the second member are rigid.

29. The method of claim 11 wherein the first leg and the second leg are rigid.

30. The locking device of claim 6 wherein the first leg and the second leg are rigid.

31. The switch locking assembly of claim 1 wherein the first member and the second member are rigid.

32. A switch locking assembly for a switch for interrupting power in a circuit path between a source and a load, comprising;

(a) an electro-mechanical assembly including first and second contacts cooperatively arranged in the circuit path for providing current from the source to the load, wherein at least one of the contacts is movable for interrupting the power provided to the load;

(b) a switch handle operatively engaged with the electro-mechanical assembly for interrupting the power provided to the load;

(c) a casing for enclosing the electro-mechanical assembly, wherein the switch handle is accessible for operation, and a pair of recesses are provided in the casing adjacent the switch handle; and (d) a locking device, comprising a first member having a first opening, a first substantially flat surface and a first end adapted to engage one of the recesses in said pair of recesses; and a second member having a second opening, a second substantially flat surface and a second end adapted to engage the second recess; said first and second members being slidably connected at a pivot point in a manner that the locking device engages the pair of recesses in a first position and disengages from the pair of recesses in the second position.

* * * * *